United States Patent [19]

De Roo et al.

[11] Patent Number: 4,478,923

[45] Date of Patent: Oct. 23, 1984

[54] FUSIBLE ELECTROSTATICALLY ATTRACTABLE TONER

[75] Inventors: Pierre R. De Roo, Schoten; Yvan K. Gilliams, Hever; Francine Van Gijsel, Beveren-Waas, all of Belgium

[73] Assignee: Agfa-Gevaert N.V., Mortsel, Belgium

[21] Appl. No.: 457,569

[22] Filed: Jan. 13, 1983

[30] Foreign Application Priority Data

Jan. 19, 1982 [GB] United Kingdom ..... 8201508

[51] Int. Cl.[3] ..... G03G 9/08

[52] U.S. Cl. ..... 430/110; 430/109

[58] Field of Search ..... 430/109, 110

[56] References Cited

U.S. PATENT DOCUMENTS 4,147,645 4/1979 Lu ..... 252/62.1 P 4,271,249 6/1981 Gilliams et al. ..... 430/101

FOREIGN PATENT DOCUMENTS 57-176060 10/1982 Japan ..... 430/109

*Primary Examiner*—John E. Kittle

*Assistant Examiner*—José G. Dees

*Attorney, Agent, or Firm*—William J. Daniel

[57] ABSTRACT

A toner composition of electrostatically attractable fusible powder particles suitable for fixing with simultaneous heat and pressure, having a melt viscosity at 140° C. in the range of $10^5$ to $10^6$ mPa.s, an average particle size in the range of 1 to 50 μm, and comprising a coloring substance and more than 80% of their volume of a mixture of: a combination of fumaric-bisphenolic and fumaric, propoxylated bisphenolic polyester resins, a sterically-hindered phenol release agent, and a melt-viscosity controlling pigment e.g. barium sulphate.

10 Claims, 1 Drawing Figure

FUSIBLE ELECTROSTATICALLY ATTRACTABLE TONER

Figure 1:
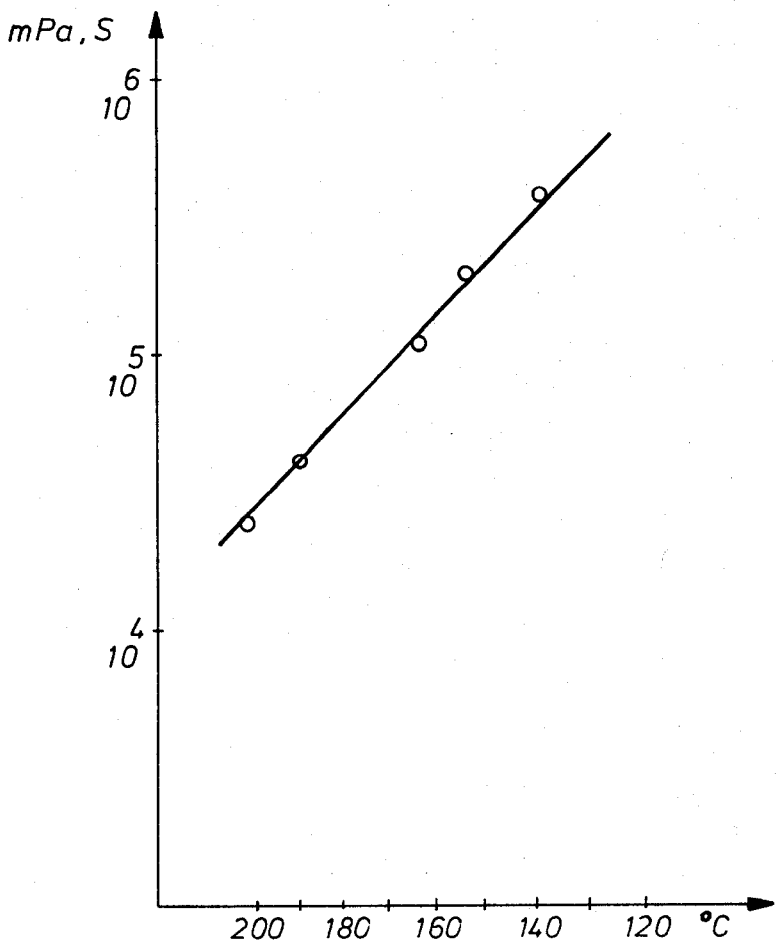

The invention relates to a composition of matter suitable for electrostatic image development and more particularly to fusible electrostatically attractable toner particles suitable for being fixed to a receptor material e.g. paper by heat- and pressure fusing, and also relates to a method for fixing such toner particles by said heat- and pressure fusing.

It is well known in the art of electrophotographic copying to form an electrostatic latent image corresponding to an original to be copied on a photoconductive member. The latent image is developed with a finely divided developing or toner to form a powder image which is then transferred onto a support sheet such as paper. The support sheet bearing the toner powder image is subsequently passed through a fusing apparatus and is thereafter discharged out of the copying machine as a final copy.

There are three generally known types of fusing processes used for fixing a toner powder image to its support. The first is an oven heating process in which heat is applied by hot air over a wide portion of the support sheet, the second is a flash heating process in which heat is produced in the toner by absorption of light energy emitted by a flash lamp and the third is a pressure heating process wherein the support with the toner image is simultaneously pressed and heated.

In a common heat- and pressure fusing process the support carrying the non-fixed toner image is conveyed through the nip formed by a fuser roller also called heating roller and another roller backing the support and functioning as pressure exerting roller.

The last mentioned process offers several advantages from the viewpoint of simplicity of heating equipment and more economical use of energy without burning or scorching the support material but is limited to a rather narrow temperature range to avoid image quality degradation.

If the fuser roller provides too much thermal energy to the toner and paper the toner will melt to a point where its viscosity is so low that "splitting" can occur, and some of the toner is transferred to the fuser roller. When splitting does occur the toner which is taken up by the fuser roller is usually transferred to the next copy sheet, giving rise to the phenomenon of "hot offset". This occurs when the toner particles are picked up by the fuser roller when there is inadequate release (cleaning). Such release is provided commonly by wetting the fuser roller with silicone oil.

If too little thermal energy is provided then the toner particles may fuse together but not bond to the paper—especially since the thermal energy is delivered through the toner. The unreleased toner particles will likewise be deposited into the next copy sheet resulting in what is called "cold offset". In both cases some toner will be transferred to the pressure roller during the lapse of time between subsequent paper feedings. Moreover, cold transfer to the paper also results in poor fix.

In order to prevent as much as possible to above described toner offset the fuser roller is coated with non-adhesive material such as silicone rubber and silicone oil or is provided with a smooth coating of polytetrafluoroethylene resin having a very low friction coefficient and low adhesivity to hydrophobic materials. Although, such coating prevents toner offset to a certain extent, a completely satisfactory solution to the problem is not obtained unless when the properties of the toner are carefully selected within proper ranges. In this respect it has been established experimentally that selected mixtures of resins in combination with a particular release agent and pigment content form toner particles that can be used within a relative broad temperature range between the hot and cold offset points, such temperature range being called fusing window.

It is an object of the present invention to provide an improved fusible electrostatically attractable toner suitable for forming fixed toner images without toner offset in heat- and pressure fusing.

It is another object of the present invention to provide toner developer particles containing synthetic resin constituents giving the toner a broad fusing window for clean and rapid heat- and pressure fusing. Other objects and advantages will become apparent from the further description.

In accordance with the present invention a toner composition consisting of electrostatically attractable fusible powder particles is provided, said composition having a melt viscosity at 140° C. in the range of $10^5$ to $10^6$ mPa.s with an average particle size in the range of 1 to 50 μm, and comprising a colouring substance and for more than 80% by volume of the total composition of a mixture of the following substances (1), (2), (3) and (4), wherein (1) is a polyester resin derived from fumaric acid, or from a mixture of fumaric acid and isophthalic acid containing at least 95 mole % of fumaric acid, and a polyol blend of propoxylated bisphenol according to the formula:

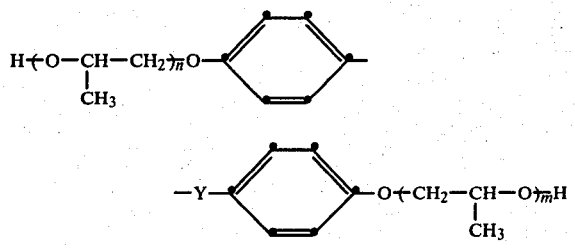

wherein Y represents an alkylidene group having from 1 to 4 C-atoms, and m and n are integers with the proviso that the average sum of m and n is from 2 to 7, said polyester resin being derived from amounts of acid and polyol such that the number of carboxyl groups to hydroxyl groups is in the ratio of 1.2:1 to 0.8:1, and said polyester has a melting point (Tm) not more than 80° C. and a glass transition temperature (Tg) between 30° and 60° C., (2) is a polyester derived from fumaric acid and a bisphenol according to the formula:

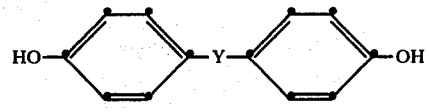

wherein Y represents an alkylidene group having from 1 to 4 C-atoms, and said polyester has a melting point (Tm) between 70° and 130° C. and a glass transition temperature (Tg) between 35° and 60° C., (3) is a sterically hindered phenol according to the formula:

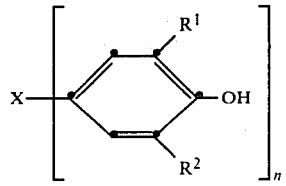

wherein each of $R^1$ and $R^2$ (same or different) represents an aliphatic group containing from 1 to 20 carbon atoms, preferably from 1 to 8 carbon atoms, however, any aliphatic group that does not adversely affect the properties of the resulting material can be used; and X is a substituted alkyl, alkenyl, alkynyl or aryl group containing as substituent a carboxylic ester, phosphonate ester, phosphate ester, sulfate ester or sulfonate ester group, and n is a number from 1 to about 4, and (4) is a pigment for controlling the melt viscosity having a density ($g.cm^{-3}$) larger than 1.8 at 20° C. and an average grain size in the range of 0.1 to 10 μm:

and wherein the weight ratio of (1) to (2) is in the range of $\frac{1}{4}$ to 4/1, and the total resin content (1)+(2) is at least 57% by volume of the toner particles, the content of (3) is between 0.25 and 18% by volume of the toner particles, and the content of said pigment is between 2.5 and 42% by volume of the toner particles.

The preparation of the polyester resins for use in electrostatic toner compositions proceeds by a common polycondensation technique more particularly as described in United Kingdom Patent Specification No. 1,373,220 filed Dec. 2, 1971 by ICI America Inc.

In the above formula of the propoxylated bisphenol used in the preparation of polyester (1) an average sum of n and m means that in the polyol blend some of the propoxylated bisphenols within the above formula may have more than 7 repeating oxypropylene units but that the average value for the number of oxypropylene units in the polyol blend is from 2 to 7 per bisphenol unit. In a preferred embodiment the propoxylated bisphenol is obtained from 2 to 3 moles of propylene oxide per mole of 2,2-bis(4-hydroxyphenyl)propane (also called "Bisphenol A").

The polyester preparation is preferably performed in an inert atmosphere, e.g. under carbon dioxide, at a moderate temperature and substantially atmospheric pressure during the early stage to reduce loss of the unsaturated acid by volatilization. As the reaction proceeds the temperature may be increased and the pressure reduced. An esterification catalyst may be used although it is generally preferred to carry out the reaction in the absence of excessive amounts of catalyst. A suitable amount of polymerization inhibitor such as hydroquinone or pyrogallol is used to suppress side polymerization through the double bond of the fumaric acid.

The procedure employed to prepare the polyesters useful in this invention generally includes heating to about 200° C. for a period of time sufficient to obtain a desired degree of esterification. The resulting polyester preferably has a low acid number i.e. of not more than 20. The acid number of a resin is determined by measuring the number of milligrams of potassium hydroxide required to neutralize 1 gram of resin. In preparing the polyester, the ratio of carboxyl groups to hydroxyl groups of the starting materials is preferably about 1:1.

A propoxylated bisphenol A-fumarate polyester particularly suitable for use according to the present invention is ATLAC T 500, trade name of Atlas Chemical Industries N.V. (Everslaan 45, B-3078 Everberg-Belgium). This polyester has a melting point (Tm) of 70°-80° C. and glass transition temperature of about 50° C. The acid number of said polyester is 13.9. Its intrinsic viscosity [η] measured at 25° C. in a mixture of phenol/ortho-dichlorobenzene (60/40 by weight) is 0.175. Its density ($g.cm^{-3}$) at 20° C. is 1.18.

A bisphenol A-fumarate polyester suitable for use according to the present invention is ATLAC 363 E, trade name of the already mentioned Atlas Chemical Industries N.V. This polyester has a melting point (Tm) of 100°-120° C. and glass transition temperature of about 50° C. Its intrinsic viscosity [η] measured at 25° C. in a mixture of phenol/ortho-dichlorobenzene (60/40 by weight) is 0.378. Its density ($g.cm^{-3}$) at 20° C. is 1.24.

The determination of the Tg value proceeded according to the technique described in the article "Thermal Analysis by a Constant Heat Flow by Ed. Steffens in Journal of Applied Polymer Science Vol. 12 pp. 2317-2324 (1968) except that one of the temperature measuring thermocouples is directly immersed into the polymer sample instead of attached to the stainless steel cover of the container containing the sample as illustrated in FIG. 1 of said article.

The melt viscosity of the toner has been measured with a DRAGE viscosimeter of Chemisches Institut Dr. A. G. Epprecht, Zurich, Switzerland. In this apparatus the shear stress (expressed in dyne/sq.cm), which depends on the melt viscosity of the mixture is graphically registered versus the corresponding speed gradient D (expressed in $s^{-1}$), which depends on the angular speed of a rotating spindle in the apparatus and also on the difference in diameter between the spindle and the cup wherein the spindle rotates.

The shear stress τ, which is measured, increases linearly with increasing speed gradient D. Depending on the magnitude of speed gradient D (between 27 $s^{-1}$ and 531 $s^{-1}$) the following relation applies:

$$n = \tau / D \text{ (expressed in mPa.s)}$$

wherein n represents the melt viscosity.

As a result of the linear relation between the logarithm of the melt viscosity and the temperature of the composition it is easy to determine the melt viscosity at 130°-170° C. by means of a simple diagram. The diagram presented in FIG. 1 gives for the toner composition of Example 1 hereinafter its melt viscosities expressed in mPa.s at different temperatures, and from this diagram can be deduced that at the preferred normal fixing temperature of about 140° C. the melt viscosity for the composition will be about $5.10^5$ mPa.s.

Illustrative examples of sterically hindered phenols (3) serving as antioxidizing agents reducing the rate of thermal decomposition of the resins of the toner are given in the U.S. Pat. No. 4,147,645. It has been established experimentally by us that these phenols (3) act as release agents preventing toner-sticking to the fuser roller surface. Preferred phenols (3) include in the X group a phosphonate ester group as in o,o-di-n-octadecyl-3,5-di-tert-butyl-4-hydroxybenzyl phosphonate.

The density ($g.cm^{-3}$) at 20° C. of this phosphonate is 1.0.

The pigment (4) having a density ($g.cm^{-3}$) larger than 1.8 serves to bring the melt viscosity of the toner into the desired range. Pigments suitable for that purpose are e.g. titanium dioxide (rutile) having a density of 4.26, barium sulphate (barite) having a density of 4.5, ferric oxide ($Fe_2O_3$=hematite) and ferrosoferric oxide ($Fe_3O_4$=magnetite) having respectively a density of 5.24 and 5.18 (ref. Handbook of Chemistry and Physics, 42nd ed., published by The Chemical Rubber Publishing Co., 2310 Superior Ave. N.E. Cleveland, Ohio—U.S.A.)

The latter two pigments serve also as colouring substance e.g. in magnetic toners. Therefore, the present invention includes toners wherein the pigment (4) serves wholly or partially as the colouring substance.

The colouring substance used in the toner particles may be any inorganic pigment (including carbon) or solid organic dyestuff pigment or mixtures thereof commonly employed in dry electrostatic toner compositions. Thus, use can be made e.g. of carbon black and analogous forms thereof, such as lamp black, channel black, and furnace black e.g. SPEZIALSCHWARZ IV (trade-name of Degussa Frankfurt/M, W. Germany) and VULCAN XC 72 (trade name of Cabot Corp. High Street 125, Boston, U.S.A.) described more in detail in U.S. Pat. No. 4,271,249.

The characteristics of preferred carbon blacks are listed in the following table 1.

TABLE 1

| | SPEZIALSCHWARZ IV | VULCAN XC 72 |
|---|---|---|
| origin | channel black | furnace black |
| density at 20° C. | 1.8 g × $cm^{-3}$ | 1.8 g × $cm^{-3}$ |
| grain size before entering the toner | 25 nm | 29 nm |
| oil number (g of linseed oil adsorbed by 100 g of pigment) | 300 | 225 |
| specific surface (sq.m per g) | 120 | 190 |
| volatile material (% by weight) | 12 | 2 |
| pH | 3 | 8.5 |
| colour | brown-black | brown-black |

Typical solid organic dyestuffs are so-called pigment dyes, which include phthalocyanine dyes, e.g. copper phthalocyanines, metal-free phthalocyanines, azo dyes, and metal complexes of azo dyes.

The following dyes in pigment form are given for illustration purposes only: FANALROSA B Supra Pulver (trade name of Badische Anilin- & Soda-Fabrik AG, Ludwigshafen, Western Germany, HELIOGENBLAU LG (trade name of BASF for a metal-free phthalocyanine blue pigment), MONASTRAL BLUE (a copper phtalocyanine pigment, C.I. 74,160). HELIOGENBLAU B Pulver (trade name of BASF), HELIOECHTBLAU HG (trade name of Bayer AG, Leverkusen, Western Germany, for a copper phthalocyanine C.I. 74,160), BRILLIANT CARMINE 6B (C.I. 18,850), and VIOLET FANAL R (trade name of BASF, C.I. 42,535).

Typical inorganic pigments include black iron(III) oxide and mixed copper(II) oxide/chromium(III) oxide/iron(III)oxide powder, milori blue, ultramarine cobalt blue, and barium permanganate. Further can be mentioned: the pigments described in the French Patent Specifications 1,394,061 filed Dec. 23, 1963 by Kodak Ltd. and 1,439,323 filed Apr. 27, 1965 by Harris Intertype Corporation.

To improve or control the chargeability of the toner particles at least one charge control agent is added to the toner particle composition as described e.g. in the published German patent application (DE-OS) 3,022,333 for yielding negatively chargeable toner particles or for yielding positively chargeable toner particles as described e.g. in the published German Patent application (DE-OS) 2,362,410 and the U.S. Pat. Nos. 4,263,389 and 4,264,702. A preferred charge control agent for offering negative charge polarity is cinnamic acid which may be used e.g. in an amount up to 5% by weight with respect to the toner.

In the preparation of the toner the colouring material and the pigment for controlling the melt viscosity, preferably barium sulphate, is added to the mixture of molten polyesters (1) and (2), and sterically hindered phenol (3) while stirring until a homogeneous mixture is obtained. After cooling, the solid mass obtained is crushed and ground e.g. in a hammer mill followed by a jet-mill to an average particle size of 1 to 50 microns. Preferably the fraction having a particle size between 1–30 μm is used.

The colouring material is normally used in an amount of 5 to 20% by volume calculated on the total weight of toner.

In order to improve the flow properties of the toner the toner particles are admixed with a metal soap e.g. zinc stearate as described e.g. in the United Kingdom Patent Specification No. 1,379,252. The preferred proportions of metal soap such as zinc stearate to toner material are in the range of 0.05 to 1% by weight. For the same purpose colloidal silica may be used, alone or in addition to the metal soap. The use of silica as flow improving agent for toner compositions is described in the United Kingdom Patent Specification No. 1,438,110.

The colloidal silica particles used in the developer composition according to the present invention are preferably free from pores i.e. have a smooth substantially spherical surface. Their specific surface area is preferably in the range of 100 to 400 sq.m/g.

Colloidal silica particles suitable for use according to the present invention are commercially available under the Trade Marks AEROSIL and CAB-O-SIL marketed by Degussa, Frankfurt (M), W. Germany and Cabot Corp. Oxides Division, Boston, Mass., U.S.A. respectively. AEROSIL 300 is a colloidal silica having a specific surface area of 300 sq.m/g. The specific surface area can be measured by a method described by Nelsen and Eggertsen in "Determination of Surface Area Adsorption Measurements by continuous Flow Method", Analytical Chemistry, Vol. 30, No. 8 (1958) 1387–1390.

The preferred proportions of colloidal silica to toner material are in the range of 0.1 to 0.5 by weight.

For a given charge density of the latent image charge-carrying surface, the maximum development density attainable with toner particles of a given size is determined by the charge/toner particle mass ratio, which is determined substantially by the triboelectric charge obtained by friction contact e.g. with carrier particles or applicator used in touch-down development as described e.g. in U.S. Pat. No. 4,271,249.

The toner compositions of the present invention may be used in cascade or magnetic brush development of electrostatic charge patterns. The carrier particles employed may be electrically conductive, insulating, magnetic or non-magnetic (for magnetic brush development they must be magnetic), as long as the carrier particles are capable of triboelectrically obtaining a charge of opposite polarity to that of the toner particles so that the toner particles adhere to and surround the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include sodium chloride, ammonium chloride, aluminum potassium chloride, Rochelle salt, sodium nitrate, aluminium nitrate, potassium chlorate, granular zircon, granular silicon, methyl methacrylate, glass, steel, nickel, iron, ferrites, ferromagnetic materials, silicon dioxides and the like. The carriers may be employed with or without a coating. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to polymer coated carriers. Oxide coated iron powder carrier particles are described e.g. in U.S. Pat. No. 3,767,477. The U.S. Pat. Nos. 3,847,604 and 3,767,578 relate to modular carrier beads on the basis of nickel. An ultimate coated carrier particle diameter between about 30 microns to about 1000 microns is preferred because the carrier particles then possess sufficient density and inertia to avoid adherence to the electrostatic images during the cascade development process. The carrier may be employed with the toner composition in any suitable combination and generally satisfactory results have been obtained when about 1 part of toner is used with about 5 to about 200 parts by weight of carrier.

The toner compositions of the present invention may be used to develop electrostatic latent images on any suitable electrostatic surface capable of retaining charge including conventional photoconductors.

The present toner composition when containing a magnetically attractable pigment e.g. $Fe_3O_4$ (black) as colouring substance can be used likewise to develop latent magnetic images. The development of latent magnetic images is described e.g. in U.S. Pat. No. 4,271,248 wherein a magnetically attractable toner suitable for flash-fusing fixing is described.

For fixing a toner image to a sheet or web support, e.g. a paper sheet, the above described toner after being deposited in image configuration on the support is conveyed between means that exert substantially equal pressure on the front and rear side of said support, while at least the means directed to the front side and contacting the toner particles is at a temperature sufficient to fuse the toner particles and has a surface with non-adhesive character thereto.

The present powder particle composition does not show toner offset at heating surface temperatures in the range of 115° to 170° C. when the surface has an non-adhesive character of such a degree that its contact angle with respect to n-butanol at 20° C. is 0°.

In a preferred embodiment the toner-image bearing support is conveyed through the nip formed by rollers rotating in opposite direction, wherein the roller contacting the toner image contains a heating source e.g. infra-red radiator or electrical resistance heating element. In most apparatus for providing the necessary pressure a spring pressure mechanism is used for actuating the pressure roller which is a support roller contacting the rear side of the toner-image bearing support. An example of a preferably used toner fixing apparatus containing a fuser and pressure roller with self-adjusting pressure mechanism is described in the U.S. Pat. No. 4,269,594. Other roller fusing devices for fixing toner images are provided with a pneumatically operated bladder to apply an equal pressure to all toner image parts. Examples of such devices are disclosed in Research Disclosure September 1981 items 20904, 20906 and 20914.

In a preferred embodiment for carrying out the fixing process the fuser roller consists of a tube of stainless steel or brass having an inner diameter of 41 mm, a wall thickness of 1.2 mm and a length of 230 mm onto which a layer of silicone rubber with a thickness of 1.0 mm is provided. Within the tube, and centrally located is provided a 1000 Watt halogen flood light lamp made by Philips Gloeilampenfabrieken N.V. This type of lamp enables the fuser roller to attain a surface temperature of 210° C. in standby condition. The pressure roller acting as support roller co-operating with the fuser roller is preferably a solid cylinder of stainless steel onto which a layer of silicone rubber with a thickness of 7 mm is provided. The diameter of the roller is 44 mm.

The pressure roller and the heat fuser roller are mounted in contact with each other and the pressure at the area of contact with the toner is adjusted at a value in the range of 0.3 to 1.4 kg per cm tangent line between the rollers.

The present powder particle composition allows support pass-through speeds between the rollers in the range of 10 to 30 $cm.s^{-1}$, the heating roller temperature being in the range of 115° to 170° C.

The following examples illustrate the invention without, however, limiting it thereto. All ratios and percentages are by weight unless otherwise defined.

EXAMPLE 1

40 parts of ATLAC T 500 (trade name) and 14 parts of ATLAC 363 E (trade name) were mixed in a kneader and heated to form a melt. 10 parts of carbon black (Spezialschwarz IV—trade name), 10 parts of o,o-di-n-octadecyl-3,5-di-tert-butyl-4-hydroxybenzyl phosphonate and 25 parts of barium sulphate (average grain size 2 μm), were added gradually to the melt and homogeneously mixed therewith. After about 20 minutes the kneading was stopped and the mixture was allowed to cool to room temperature (20° C.). At that temperature the mixture was crushed and milled to form a powder. From the obtained powder, toner particles with a size between 1 and 30 μm were separated. To improve the flow properties of the toner 0.1 parts of zinc stearate and 0.3 parts of colloidal silica (AEROSIL R 972—trade name) were admixed thereto. The fusing window of this toner, in heat- and pressure fixing with a fuser and pressure roller as described in U.S. Pat. No. 4,269,594 is 130° to 170° C.

EXAMPLE 2

Example 1 was repeated with the difference however, that in the mixture of that example 4 parts of ATLAC 363 E (trade name) were replaced by 4 parts of ATLAC T 500 (trade name). There is no longer a fusing window available.

EXAMPLE 3

Example 1 was repeated with the difference however, that in the mixture of that example 10 parts of ATLAC T 500 (trade name) and 44 parts of ATLAC 363 E (trade name) were used. The fusing window of this toner was 145° to 185° C. The energy required however, to crush and mill this mixture to form a powder including particles with a size between 1 and 30 μm was too high for practical purposes.

EXAMPLE 4

Example 1 was repeated with the difference however, that in the mixture of that example ATLAC 363 E (trade name) was replaced by 14 parts of poly(styrene-n-butylmethacrylate)(65/35) having an intrinsic viscosity measured at 25° C. in n-butanone of 0.186 and Tg value of 52° C. There is no fusing window available.

EXAMPLE 5

Example 1 was repeated with the difference however, that in the mixture of that example 15 parts of the phosphonate were used. The amounts of the other ingredients were the same as in Example 1. There is no longer a fusing window available.

EXAMPLE 6

Example 1 was repeated with the difference however, that in the mixture of that example 5 parts of barium sulphate were used. The amounts of the other ingredients were the same as in Example 1. There is no longer a fusing window available.

EXAMPLE 7

Example 1 was repeated with the difference however, that in the mixture of that example 2 parts of carbon black were replaced by 2 parts of cinnamic acid. The fusing window of the toner was still 130° to 170° C.

What is claimed is:

1. A toner composition of electrostatically attractable powder particles fusible by the simultaneous application of heat and pressure, said particles having a melt viscosity at 140° C. in the range of $10^5$ to $10^6$ mPa.s and an average particle size in the range of 1 to 50 μm, said toner composition comprising a colouring substance and an amount exceeding 80% of its total volume of a mixture of:

(1) a polyester resin derived from fumaric acid, or from a mixture of fumaric acid and isophthalic acid containing at least 95 mole % of fumaric acid, and a polyol blend of propoxylated bisphenol according to the formula:

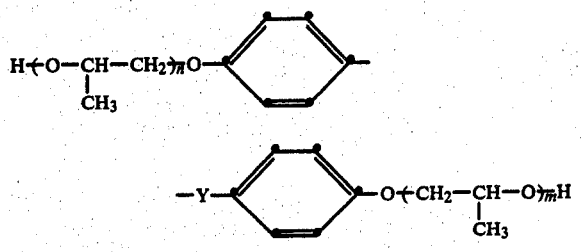

wherein Y represents an alkylidene group having from 1 to 4 C-atoms, and m and n are integers with the proviso that the average sum of m and n is from 2 to 7, said polyester resin being derived from amounts of acid and polyol such that the number of carboxyl groups to hydroxyl groups is in the ratio of 1.2:1 to 0.8:1, and having a melting point (Tm) not more than 80° C. and a glass transition temperature (Tg) between 30° and 60° C.;

(2) a polyester derived from fumaric acid and bisphenol according to the formula:

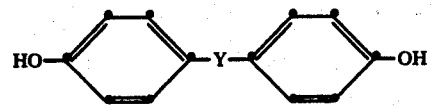

wherein Y represents an alkylidene group having from 1 to 4 C-atoms, and said polyester has a melting point (Tm) between 70° and 130° C. and a glass transition temperature (Tb) between 35° and 60° C.;

(3) a sterically-hindered phenol according to the formula:

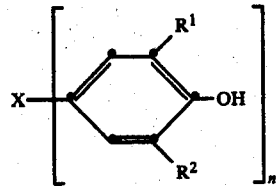

wherein $R^1$ and $R^2$ (same or different) each represent an aliphatic group containing from 1 to 20 carbon atoms and X is a substituted alkyl, alkenyl, alkynyl or aryl group, containing as substituent a carboxylic ester, phosphonate ester, phosphate ester, sulfate ester or sulfonate ester group, and n is an integer from 1 to 4; and (4) a pigment for controlling the melt viscosity having a density ($g.cm^{-3}$) larger than 1.8 at 20° C. and an average grain size in the range of 0.1 to 10 μm, wherein the weight ratio of (1) to (2) is in the range of 1/4 to 4/1, the sum of the contents of resins (1)+(2) is at least 57% by volume of the toner particles, the content of (3) is between 0.25 and 18% by volume of the toner particles, and the content of said pigment is between 2.5 and 42% by volume of the toner particles.

2. A composition according to claim 1, characterized in that substance (1) is a polyester resin of fumaric acid and a propoxylated bisphenol obtained from 2 to 3 moles of propylene oxide per mole of 2,2-bis(4-hydroxyphenyl)propane, and having a melting point (Tm) of 70°-80° C. and glass transition temperature of about 50° C., and wherein substance (2) is a polyester of fumaric acid and 2,2-bis(4-hydroxyphenyl)propane having a melting point (Tm) of 100°-120° C. and a glass transition temperature of about 50° C.

3. A composition according to claim 1, characterized in that substance (3) is a phenol including in the X group a phosphonate ester group as substituent.

4. A composition according to claim 1, characterized in that said pigment (4) is barium sulphate.

5. A composition according to claim 1, characterized in that the said pigment is ferric oxide or ferrosoferric oxide, and at least partially constitutes said colouring substance.

6. A composition according to claim 1, characterized in that the colouring substance is carbon black.

7. A composition according to claim 1, characterized in that the toner particles have an average particle size in the range of 1 to 30 μm.

8. A composition according to claim 1, characterized in that the composition contains in admixture with the powder particles as flow improving agent colloidal silica and/or zinc stearate.

9. A composition according to claim 1, characterized in that the toner particles contain cinnamic acid as charge control agent.

10. A composition according to claim 1, characterized in that the toner particles are mixed with carrier particles for cascade or magnetic brush development of electrostatic charge patterns.

* * * * *